US008217841B2

(12) United States Patent
Hossain et al.

(10) Patent No.: US 8,217,841 B2
(45) Date of Patent: Jul. 10, 2012

(54) FREQUENCY TUNABLE ANTENNA

(75) Inventors: Golam Sorwar Hossain, Kawasaki (JP); Takashi Yamagajo, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 349 days.

(21) Appl. No.: 12/696,729

(22) Filed: Jan. 29, 2010

(65) Prior Publication Data

US 2010/0245201 A1 Sep. 30, 2010

(30) Foreign Application Priority Data

Mar. 30, 2009 (JP) ..... 2009-082770

(51) Int. Cl.
*H01Q 1/38* (2006.01)

(52) U.S. Cl. ..... 343/700 MS; 343/702

(58) Field of Classification Search ..... 343/700 MS, 343/702, 846, 848
See application file for complete search history.

(56) References Cited

U.S. PATENT DOCUMENTS

| | | | | |
|---|---|---|---|---|
| 7,372,406 | B2 * | 5/2008 | Shiotsu et al. | 343/700 MS |
| 8,077,116 | B2 * | 12/2011 | Shamblin et al. | 343/895 |
| 2006/0181464 | A1 * | 8/2006 | Erkocevic | 343/702 |
| 2007/0069958 | A1 * | 3/2007 | Ozkar | 343/700 MS |
| 2008/0055164 | A1 * | 3/2008 | Zhang et al. | 343/702 |
| 2008/0150808 | A1 * | 6/2008 | Asrani et al. | 343/702 |

FOREIGN PATENT DOCUMENTS

| | | | |
|---|---|---|---|
| JP | 2000-124728 | A | 4/2000 |
| JP | 2007-300398 | A | 11/2007 |

* cited by examiner

*Primary Examiner* — Hoanganh Le
(74) *Attorney, Agent, or Firm* — Westerman, Hattori, Daniels & Adrian, LLP

(57) ABSTRACT

There is provided an antenna for tuning a resonant frequency. The antenna includes a first and a second arms connected to the antenna feeding portion at a common end thereof. The second arm has each of the plurality of branches including a switch for selecting a length of an electrical loop formed by the second arm and an end of a ground plane, each of the switches is connected to the ground plane. A first resonant frequency performed by the first arm is higher than a second resonant frequency by the second arm when each of the switches is open, and the first resonant frequency is lower than a third resonant frequency by the second arm when one of the switches is selected to connect the second arm and the ground plane so that the length of the electrical loop is maximum.

10 Claims, 9 Drawing Sheets

FREQUENCY TUNABLE ANTENNA

CROSS-REFERENCE TO RELATED APPLICATIONS

This application is based upon and claims the benefit of priority of the prior Japanese Patent Application No. 2009-082770, filed on Mar. 30, 2009, the entire contents of which are incorporated herein by reference.

FIELD

The embodiments discussed herein are related to an antenna.

BACKGROUND

New mobile telephone communication standards have been defined. The standards such as Long Term Evolution (LTE) and LTE-Advanced, and a set of standards for the fourth generation of mobile telephones (4G) have been developed by the Third Generation Partnership Project (3GPP), which is a standardization organization, and the International Telecommunication Union (ITU) respectively. It is expected in these standards that frequencies ranging from a few 100 MHz to about 3.5 GHz will be used. Furthermore, when the Worldwide Interoperability for Microwave Access (WiMAX) or wireless local area network (LAN) function is to be included in wireless terminals in the future, antennas to be included in the terminals may transmit and receive electromagnetic waves with a frequency of about 6 GHz.

The antennas of mobile telephones are primarily required to be small. Secondly, the antennas are required to have a higher capability to be able to handle multiple frequency bands over a wide frequency range. Various antennas for the purpose of use in multiple frequency bands are proposed. Japanese Laid-open Patent Publication No. 2007-300398 discloses an antenna configured as illustrated in FIG. 9. The antenna is a monopole antenna with multiple arms 214 and 216 connecting with a radiating element 212 via branching portions 213 and 215, where reference numerals 210 and 211 are a circuit board and a feeding point respectively. The individual arms 214 and 216 have different resonant frequencies each other.

Further, Japanese Laid-open Patent Publication No. 2000-124728 discloses an antenna configured as illustrated in FIG. 10. The antenna has been disclosed as conventional multi-frequency antenna, where the antenna includes a tabular conductor 316, capacitances 317, a feeding point 318, switches 319, and an excitation source 321 on a virtual ground plane 300. This antenna is a loop antenna that may select one of multiple impedances by using switches 319.

SUMMARY

According to an aspect of the disclosed technique, there is provided an antenna for tuning a resonant frequency and operable with a ground plane connected through an antenna feeding portion. The antenna includes a first arm connected to the antenna feeding portion at an common end thereof, a second arm connected to the antenna feeding portion at the common end thereof and having a plurality of branches, each of the plurality of branches including a switch for selecting a length of an electrical loop formed by the second arm and an end of the ground plane, each of the switches individually connected to each of the plurality of branches and the ground plane, wherein a first resonant frequency performed by the first arm is higher than a second resonant frequency performed by the second arm when each of the switches is open, and the first resonant frequency is lower than a third resonant frequency performed by the second arm when one of the switches is selected to connect the second arm and the ground plane so that the length of the electrical loop is maximum.

The object and advantages of the invention will be realized and attained by means of the elements and combinations particularly pointed out in the claims. It is to be understood that both the foregoing general description and the following detailed description are exemplary and explanatory and are not restrictive of the invention, as claimed.

DESCRIPTION OF EMBODIMENTS

Figure 9:
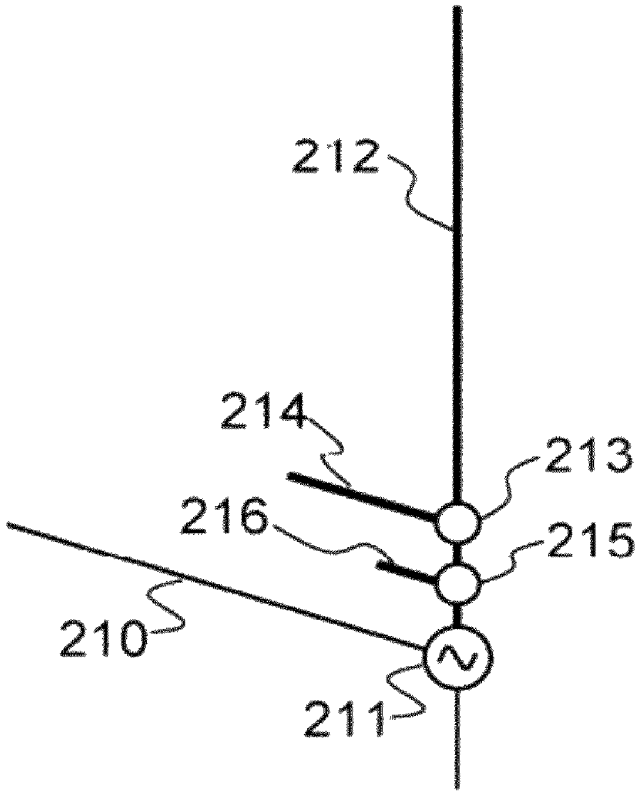
FIG. 9 is a diagram of a first related art.

The first antenna illustrated in FIG. 9 may handle multiple frequency bands, however the antenna may not handle a wide frequency range from a few 100 MHz to 6 GHz, which is expected to be employed in the future.

Figure 10:
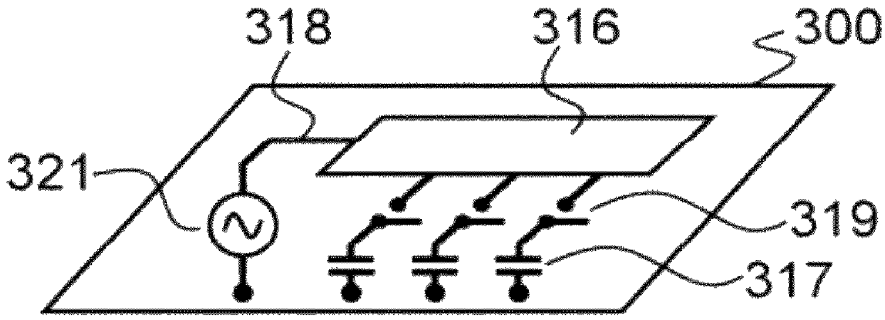
FIG. 10 is a diagram of a second related art.

The second antenna illustrated in FIG. 10 may be also disadvantageous in handling a wide frequency range, while the antenna is only adjustable around a specific frequency band of a few 100 MHz. The second antenna is configured to change its resonant frequency by changing the impedance by using the switches. The antenna is not configured to handle a wide frequency range.

Figure 1:
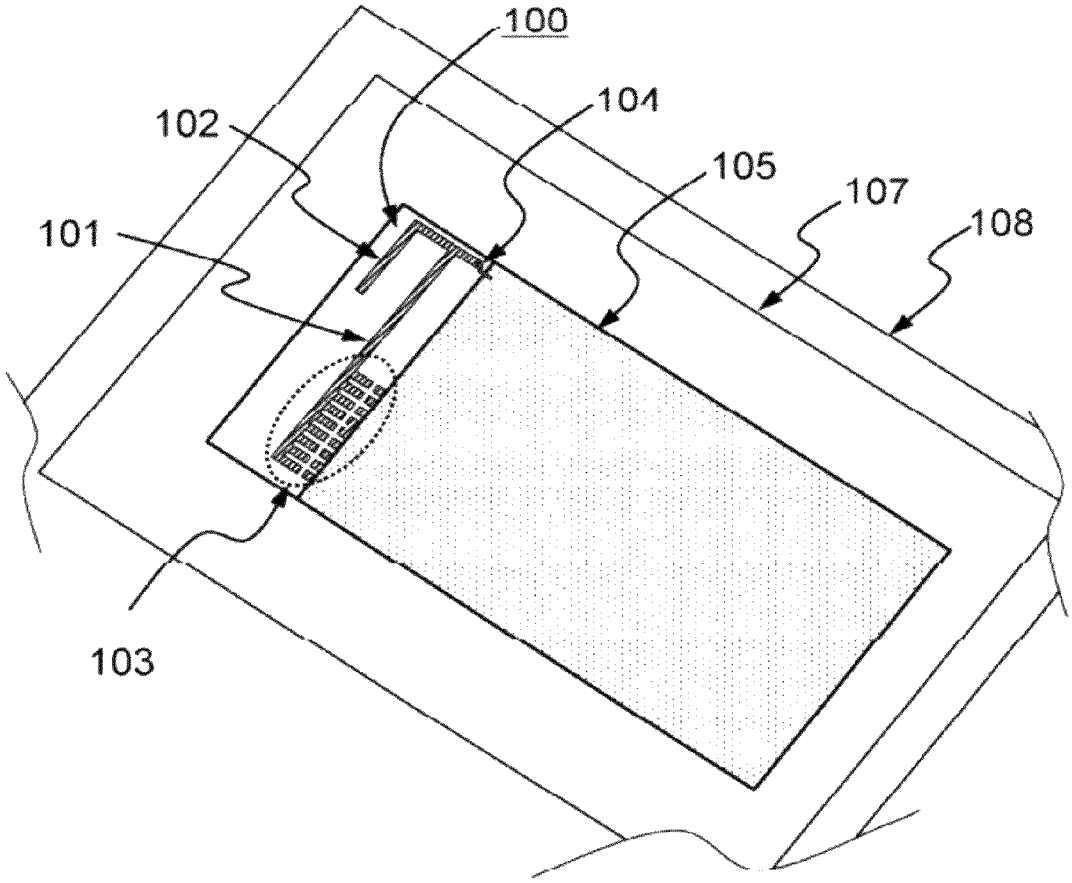
FIG. 1 is a diagram of a frequency-adjustable antenna according to an embodiment.
Figure 2:
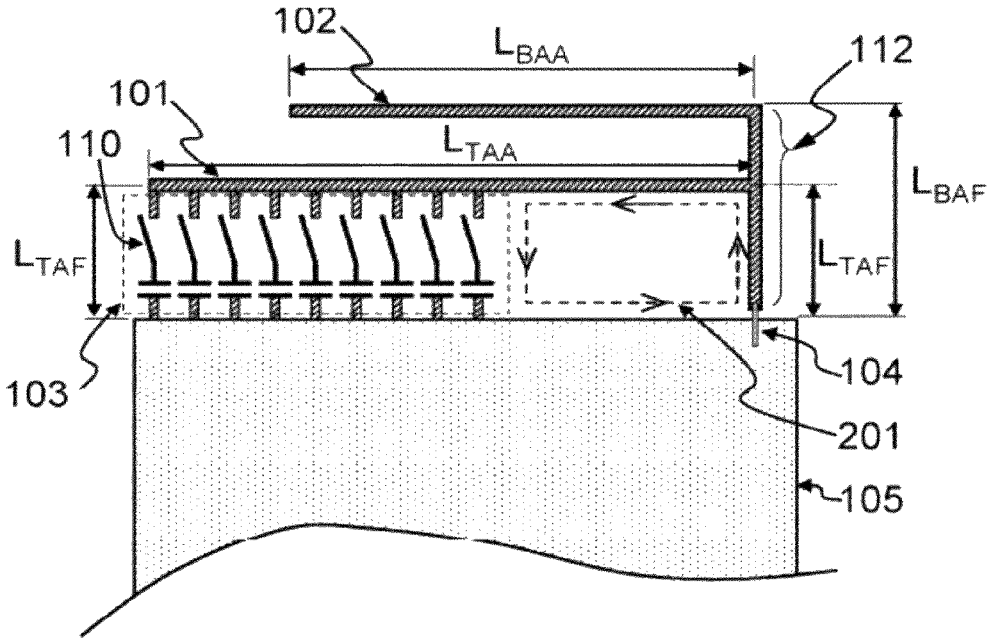
FIG. 2 is a diagram illustrating an operation of the antenna of the embodiment.

Hereinafter, an embodiment will be descried in detail. FIG. 1 is a diagram of a frequency-adjustable antenna according to an embodiment realized by the disclosed technique. FIG. 2 is a diagram illustrating an operation of the antenna of the embodiment.

The antenna 100 may be mounted, together with a ground plane 105 that is earthed, on a printed circuit board 107 in a case 108 of a mobile phone so that the antenna 100 may be applicable to a mobile phone and even a future-generation mobile telephone terminal. The antenna 100 includes two radiating arms, a first arm is a band arm 102 and a second arm is an adjustment arm 101. The adjustment arm 101 is a loop antenna that forms an electrical loop 201 (FIG. 2) with the ground plane 105. The band arm 102 is a reverse-L-shaped monopole antenna.

The dimensions of the band arm 102 are designed to contribute to extend the band of the antenna. The dimensions of the adjustment arm 101 are designed to control the adjustment operation of the antenna 100. The band arm 102 is provided to be more distant than the adjustment arm 101 from an end side of the ground plane 105.

A switched capacitor bank 103 including a plurality of parallel branches is connected as a radio-frequency switch bank to the adjustment arm 101. At each switch branch of the switched capacitor bank 103, as illustrated in FIG. 2, a switched capacitor 110 is formed between the adjustment arm 101 and the ground plane 105. By selecting which switched capacitor 110 to turn on, as illustrated in FIG. 2, the peripheral length of the electrical loop 201 is changed, thereby changing the operating band. Accordingly, the frequency band may be adjusted.

As illustrated in FIG. 1 or 2, the adjustment arm 101 and the band arm 102 share a arm 112 of which end is connected to an antenna feeding portion 104. As described above, the antenna 100 of the embodiment has two main sections, the adjustment arm 101, which has the role of adjustment, and the band arm 102, which extends the frequency band. Since the antenna 100 may realize a plurality of resonant structures by using the switch branches of the switched capacitor bank 103, the antenna 100 may provide an adjustable range over a wide range.

Referring to FIG. 2, the adjustment arm 101 has a length $L_{TA}$ expressed by the following equation:

$$L_{TA}=2\times L_{TAF}+L_{TAA} \quad (1)$$

where $L_{TAA}$ denotes the length of a long side of the adjustment arm 101 that is parallel to the end side of the ground plane 105, and $L_{TAF}$ denotes the length of each of two short sides of the adjustment arm 101 that are orthogonal to the end side of the ground plane 105. The band arm 102 has a $L_{BA}$ expressed by the following equation:

$$L_{BA}=L_{BAF}+L_{BAA} \quad (2)$$

where $L_{BAA}$ denotes the length of a long side of the band arm 102 that is parallel to the end side of the ground plane 105, and $L_{BAF}$ denotes the length of a short side of the band arm 102 that is orthogonal to the end side of the ground plane 105. The relationship between $L_{TA}$ and $L_{BA}$ is carefully designed so as to achieve both the adjustment capability and the band extension capability.

Figure 3A:
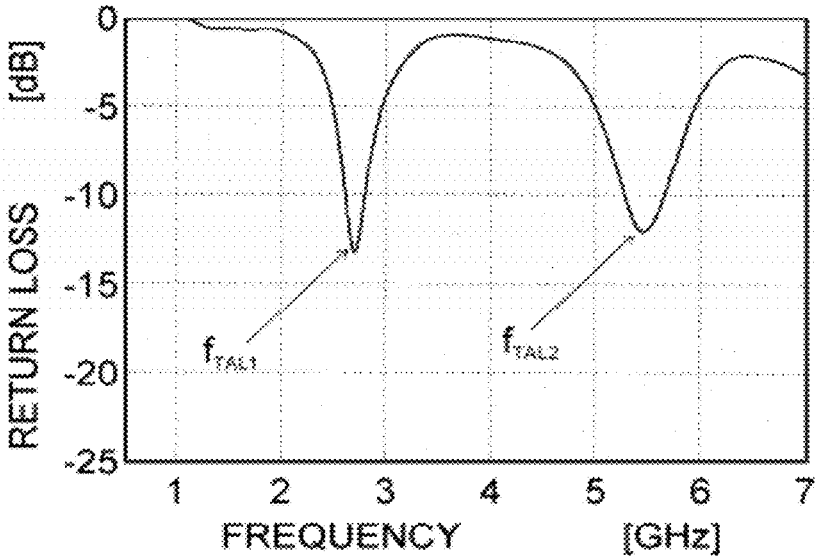
FIGS. 3A and 3B are diagrams illustrating the relationship between the dimensions of an adjustment arm and a resonant frequency.
Figure 3B:
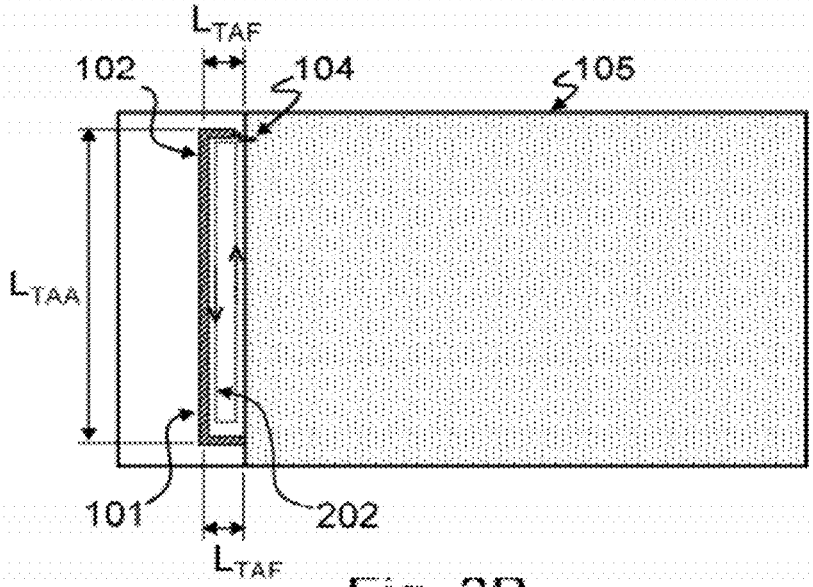
Figure 4A:
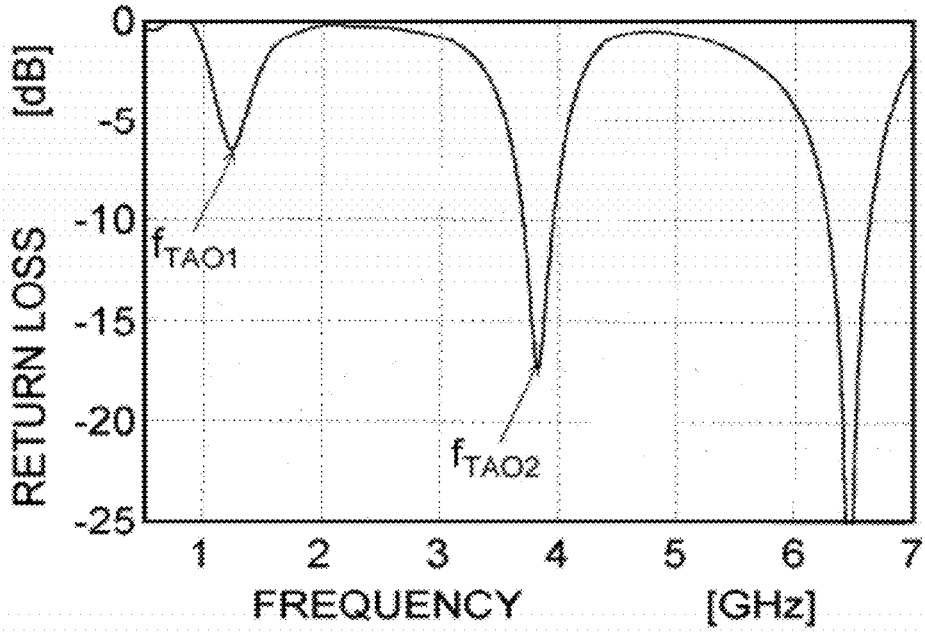
FIGS. 4A and 4B are diagrams illustrating the relationship between the dimensions of the adjustment arm and the resonant frequency.
Figure 4B:
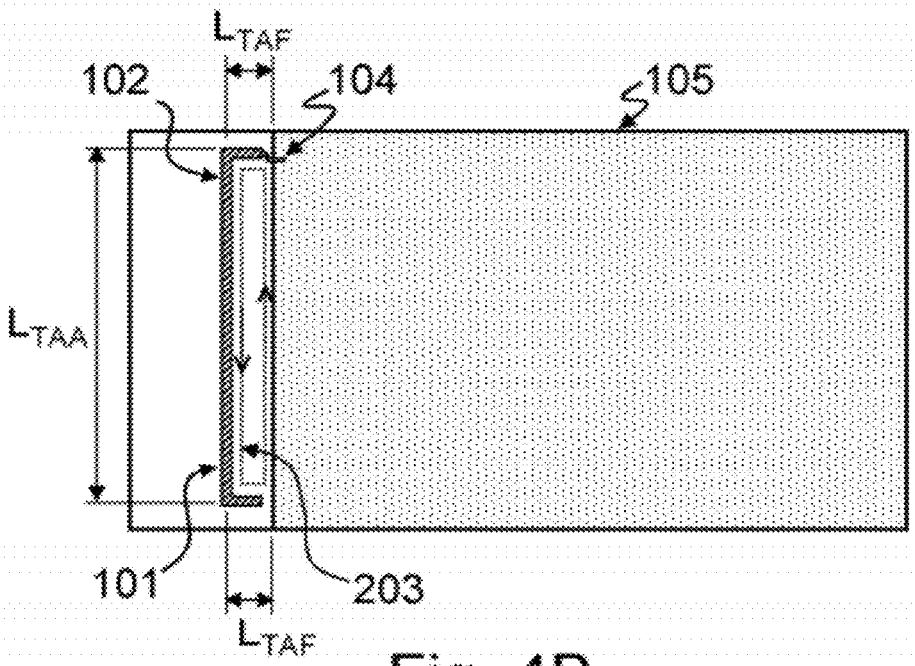

FIGS. 3A, 3B, 4A, and 4B are diagrams illustrating the relationships between the dimensions of the adjustment arm 101 and the resonant frequency. Firstly, as illustrated in FIGS. 3A and 3B, the case where the switch at the left end of the switched capacitor bank 103 in FIG. 2 is turned on, and the adjustment arm 101 and the ground plane 105 are connected to each other will be considered. In this case, the adjustment arm 101 having the length $L_{TA}$ expressed by equation (1) forms a large closed loop 202 in FIG. 3B that provides a first resonant frequency $f_{TAL1}$ and a second resonant frequency $f_{TAL2}$ as illustrated in FIG. 3A. The distance between the switch branch portion and the antenna feeding portion 104 is set to be equal to the length $L_{TAA}$ of the long side of the adjustment arm 101 when the switched capacitor at the left end in FIG. 2 is turned on. When the switched capacitor is turned off, the adjustment arm 101 forms a large open loop 203 in FIG. 4B that provides a first resonant frequency $f_{TAO1}$ and a second resonant frequency $f_{TAO2}$ as illustrated in FIG. 4A. The resonant frequencies have the following relationships:

$$f_{TAL1}>f_{TAO1}, f_{TAL2}>f_{TAO2}.$$

Figure 5A:
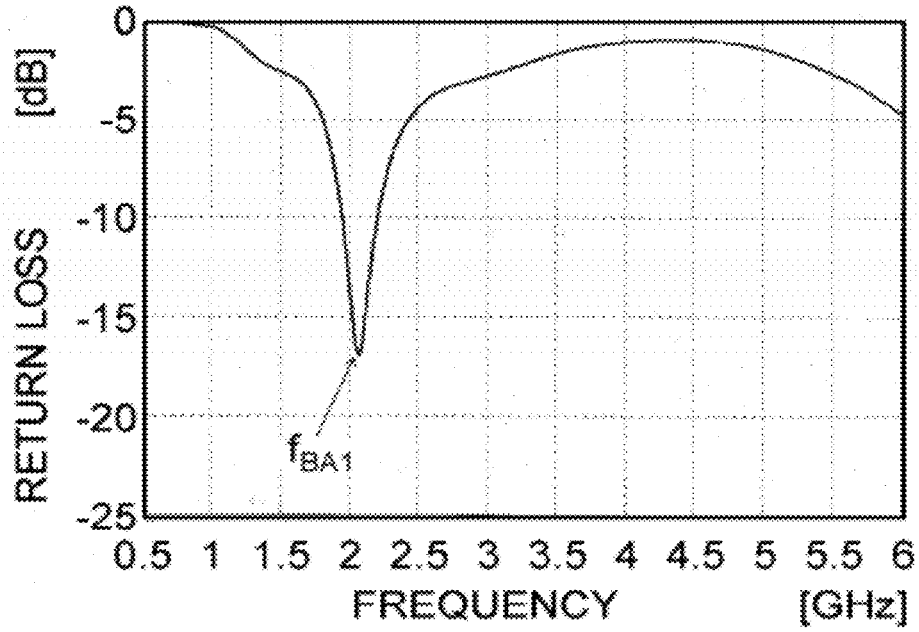
FIGS. 5A and 5B are diagrams illustrating the relationship between the dimensions of a band arm and the resonant frequency.
Figure 5B:
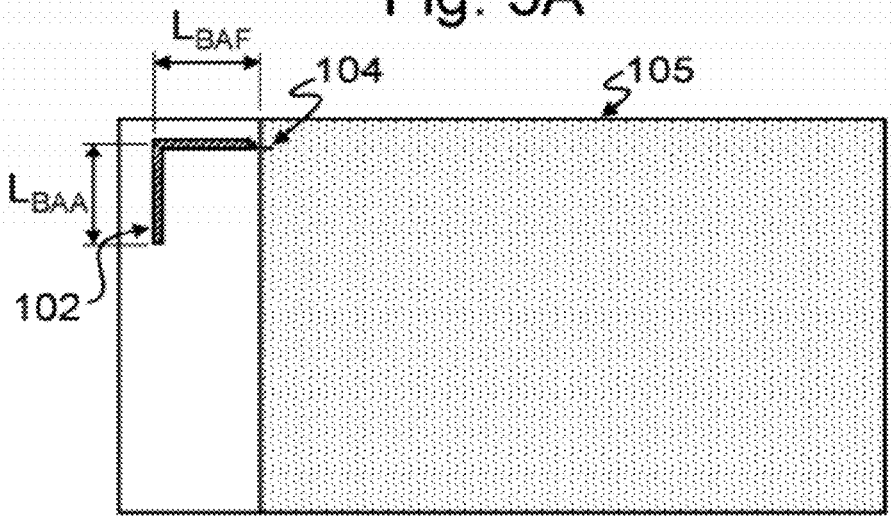

FIGS. 5A and 5B are diagrams illustrating the relationship between the dimensions of the band arm 102 and the resonant frequency. The band arm 102, which is reverse-L-shaped and which has the length $L_{BA}$ expressed by equation (2), is designed so that its first resonant frequency $f_{BA1}$ results in between $f_{TAO1}$ and $f_{TAL1}$. That is, the relationship represented by the following expression is set:

$$f_{TAO1}<f_{BA1}<f_{TAL1} \quad (3)$$

In this case, the following relationship holds:

$$L_{TA}>L_{BA} \quad (4)$$

The reason $f_{BA1}$ is set to satisfy the expressions (3) and (4) is that these expressions allows; the resonant frequency not to overlap a loop resonant frequency having a cancelling effect in a loop resonance; and the resonant frequency not to become equal to or less than $f_{TAO1}$ in the lower frequency band which does not contribute to extend the band.

Figure 6A:
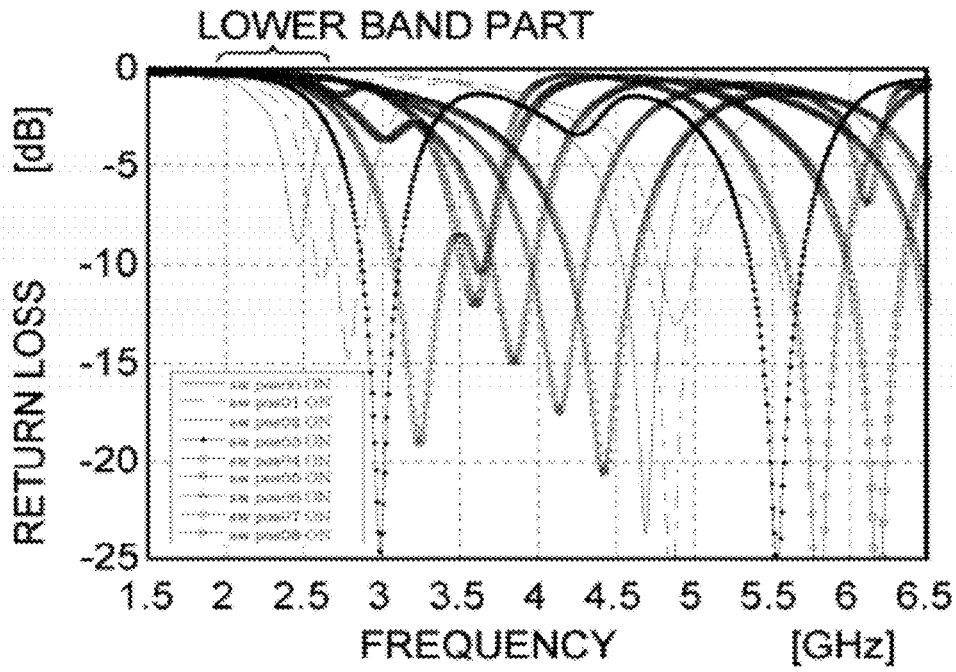
FIGS. 6A and 6B are diagrams illustrating calculation examples of return loss data.
Figure 6B:
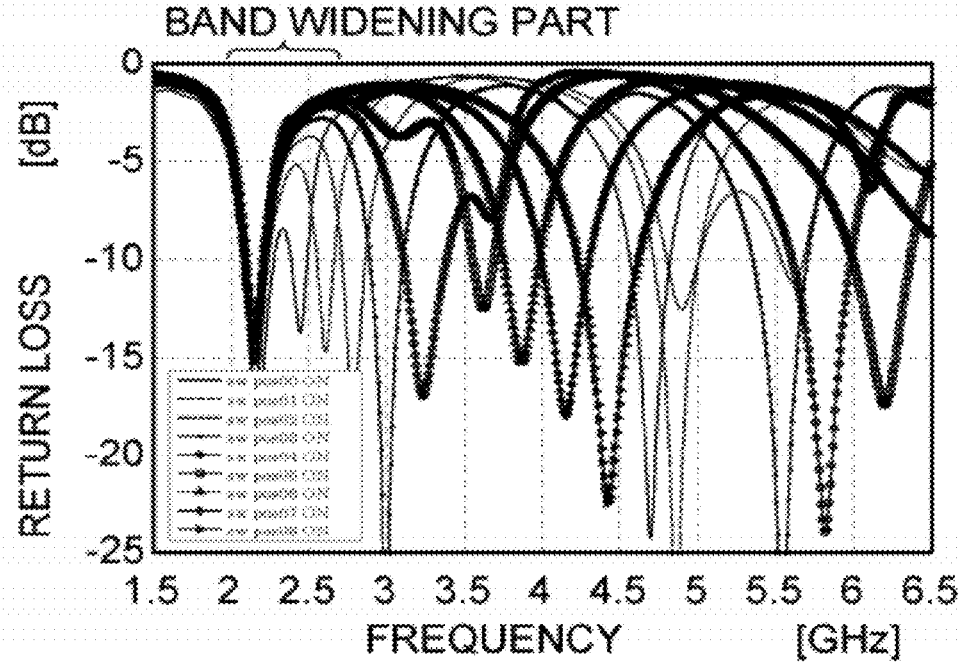

FIG. 6A is a diagram illustrating a calculation example of return loss data in the case where the length $L_{BA}$ of the band arm 102, which is expressed by equation (2), is about 27 mm; the length $L_{TA}$ of the adjustment arm 101, which is expressed by equation (1), is about 49 mm; and the first resonant frequency is set so as to satisfy the relationship represented by expression (3). FIG. 6B is a diagram illustrating a calculation example of return loss data in the case where the band arm 102 is not provided. In FIGS. 6A and 6B, the parameter indicates the switched capacitor turned on such that "sw pos00 ON" means "only the leftmost switched capacitor 102 in FIG. 2 is on and other switched capacitors are off. Even in FIGS. 7A and 8A, the parameters will have the same meaning of parameters in FIGS. 6A and 6B.

As illustrated in FIG. 6B, when there is no band arm 102, it is difficult to set the resonant frequency to a lower band less than or equal to 3 GHz. In contrast, as illustrated in FIG. 6A, the structure of the embodiment illustrated in FIG. 1 in which the band arm 102 is provided may set the resonant frequency to a lower band near 2 GHz. Multiple characteristic curves illustrated in FIG. 6A represent the case where switching is made among the switch branches of the switched capacitor bank 103. By switching among the switch branches of the switched capacitor bank 103 in accordance with these characteristic curves, the resonant frequency may be variously changed over a wide frequency range.

Figure 7A:
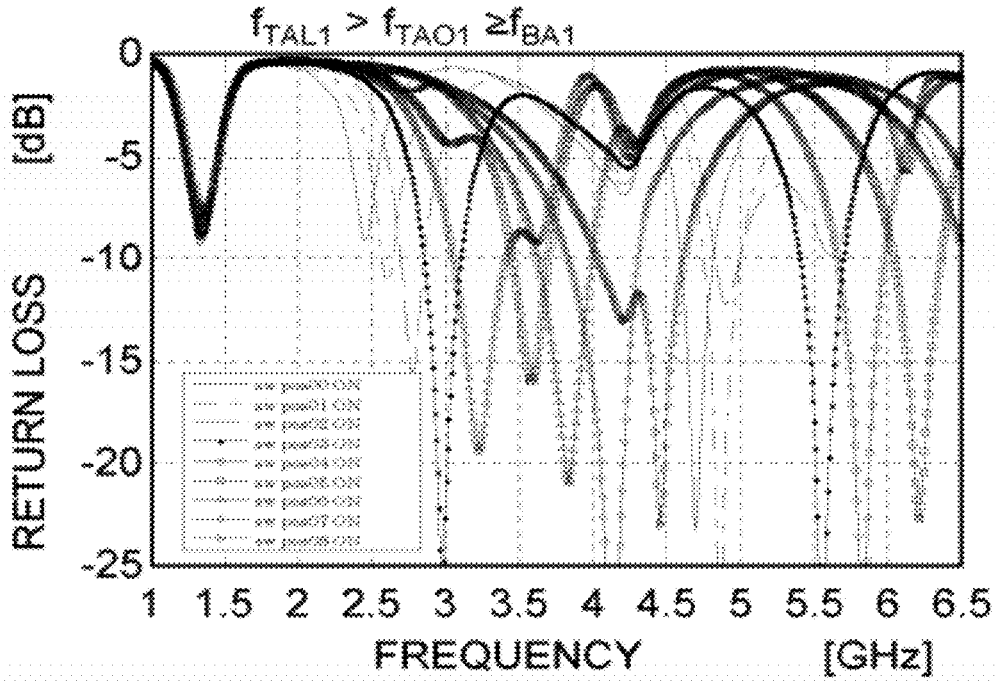
FIGS. 7A and 7B are diagrams illustrating another calculation example of return loss data.
Figure 7B:
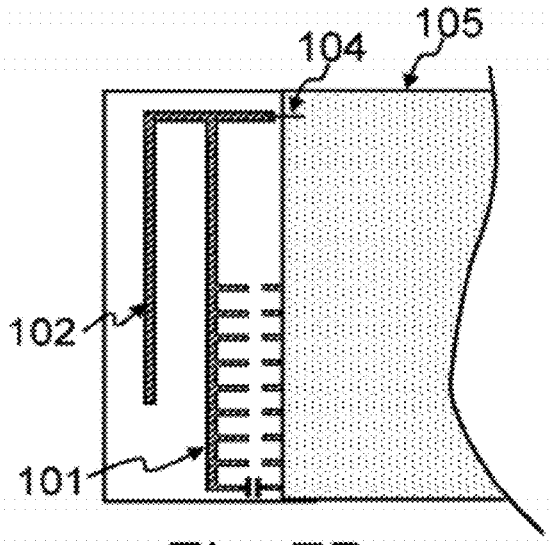
Figure 8A:
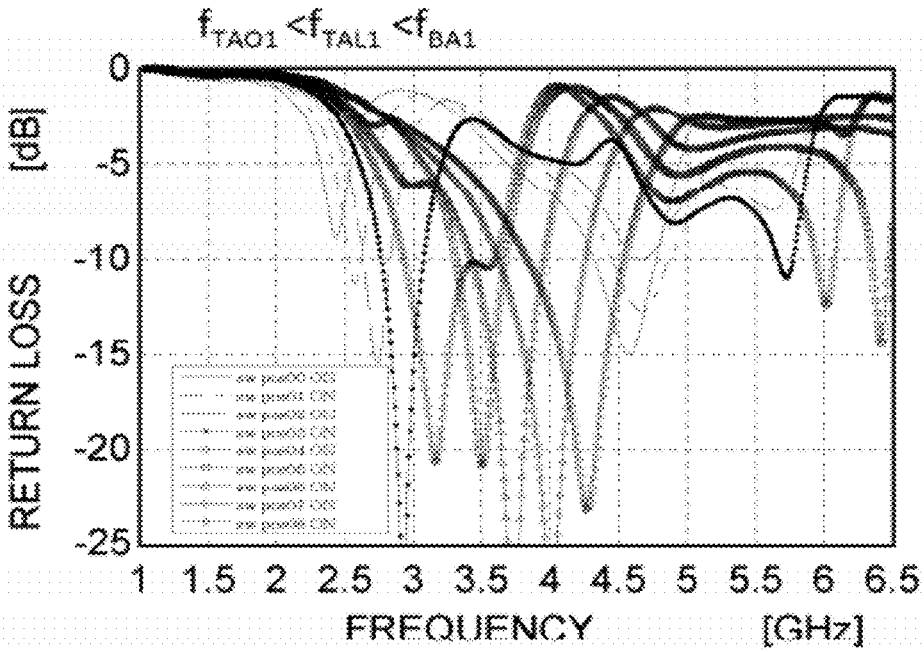
FIGS. 8A and 8B are diagrams illustrating another calculation example of return loss data.
Figure 8B:
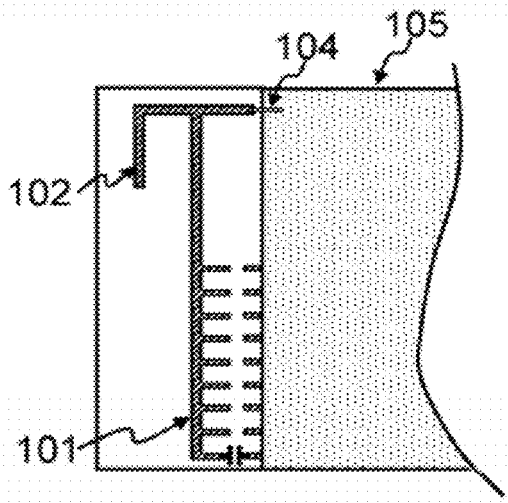

In the embodiment, the band arm 102 also serves to limit the band extension so that the resonant frequency will not fall outside the designed conditions, as described above. FIG. 7A is a diagram illustrating a calculation example of return loss data in the case where the relationship represented by expression (3) is not satisfied, and, as illustrated in FIG. 7B, the band arm 102 is too long. FIG. 8A is a diagram illustrating a calculation example of return loss data in the case where the relationship represented by expression (3) is not satisfied, and, as illustrated in FIG. 8B, the band arm 102 is too short. These drawings indicate that sufficient broadband characteristics are not achieved in any of these cases. That is, the relationship represented by expression (3) is very important.

According to the above-described embodiment, a small, broadband-adjustable antenna that is a combination of a loop antenna and a monopole antenna may be realized. The antenna may be easily formed on a printed circuit board. In this case, the adjustment arm 101, the band arm 102, and the switched capacitor bank 103 are provided on the same side of the printed circuit board as the ground plane 105. The antenna of the present embodiment may be mounted so that no elements included in the antenna are provided on the opposite side of the printed circuit board. Accordingly, the utilization ratio of the printed circuit board may be improved.

In the above-described embodiment, the switched capacitor bank 103 is not limited to a switched capacitor, but extends to various other devices that may operate as radio frequency switch banks.

The disclosed technique may be used in, for example, antennas of wireless devices whose resonant frequencies are adjusted to a broad band greater than or equal to 4 GHz, and antennas of the next-generation mobile telephones requiring operation in multiple bands ranging from 600 MHz to 6 GHz.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present inventions have been described in detail, it should be understood that the various changes, substitutions, and alterations could be made hereto without departing from the spirit and scope of the invention.

What is claimed is:

1. An antenna for tuning a resonant frequency and operable with a ground plane connected through an antenna feeding portion, comprising:

a first arm connected to the antenna feeding portion at a common end thereof;

a second arm connected to the antenna feeding portion at the common end thereof and having a plurality of branches, each of the plurality of branches including a switch for selecting a length of an electrical loop formed by the second arm and an end of the ground plane, each of the switches individually connected to each of the plurality of branches and the ground plane;

wherein a first resonant frequency performed by the first arm is higher than a second resonant frequency performed by the second arm when each of the switches is open, and the first resonant frequency is lower than a third resonant frequency performed by the second arm when one of the switches is selected to connect the second arm and the ground plane so that the length of the electrical loop is maximum.

2. The antenna according to claim 1, wherein the switch is a switched capacitor.

3. The antenna according to claim 1, wherein the first arm is an invert L monopole antenna.

4. The antenna according to claim 3, wherein a boundary length of the first arm is a sum of lengths of a long side and a short side of a figure of the invert L monopole antenna, a boundary length of the second arm is a sum of twice of a length of a short side and a length of a long side thereof, and the boundary length of the second arm is longer than the boundary of the first arm.

5. The antenna according to claim 1, wherein the second arm is disposed between the first arm and the end of the ground plane.

6. The antenna according to claim 3, wherein the second arm is disposed between the first arm and the end of the ground plane.

7. The antenna according to claim 1, wherein a maximum distance between the antenna feed portion and a portion of the one of the plurality of the branches is equal to the long side of the second arm.

8. The antenna according to claim 3, wherein a maximum distance between the antenna feed portion and a portion of the one of the plurality of the branches is equal to the long side of the second arm.

9. The antenna according to claim 1, wherein the ground plane is formed on a printed circuit board, and the first and second arms and the plurality of the switches are on a same side of the printed circuit board on which the ground plane is formed.

10. The antenna according to claim 3, wherein the ground plane is formed on a printed circuit board, and the first and second arms and the plurality of the switches are on a same side of the printed circuit board on which the ground plane is formed.

* * * * *